US011203173B2

(12) United States Patent
Iori et al.

(10) Patent No.: US 11,203,173 B2
(45) Date of Patent: Dec. 21, 2021

(54) BOX MAKING MACHINERY AND METHOD FOR ADJUSTING PROCESSING POSITION OF CORRUGATED BOARDS

(71) Applicant: MITSUBISHI HEAVY INDUSTRIES MACHINERY SYSTEMS, LTD., Hyogo (JP)

(72) Inventors: Shinya Iori, Hiroshima (JP); Makoto Shimohatsubo, Hiroshima (JP); Yasunari Suzuki, Hiroshima (JP); Kazunori Hosoya, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 409 days.

(21) Appl. No.: 16/321,748

(22) PCT Filed: Sep. 27, 2017

(86) PCT No.: PCT/JP2017/035052
§ 371 (c)(1),
(2) Date: Jan. 29, 2019

(87) PCT Pub. No.: WO2019/064392
PCT Pub. Date: Apr. 4, 2019

(65) Prior Publication Data

US 2021/0178720 A1 Jun. 17, 2021

(51) Int. Cl.
*B31B 50/00* (2017.01)
*B31B 50/04* (2017.01)
(Continued)

(52) U.S. Cl.
CPC ..... *B31B 50/006* (2017.08); *B31B 50/042* (2017.08); *B31B 50/146* (2017.08);
(Continued)

(58) Field of Classification Search
CPC ..... B65H 5/062; B31B 2100/002; B31B 2120/302; B31B 2120/70; B31B 50/006;
(Continued)

(56) References Cited

U.S. PATENT DOCUMENTS 4,458,893 A * 7/1984 Ruh ..... B41F 21/05 101/248
4,604,083 A * 8/1986 Barny ..... B31B 50/00 493/28
(Continued)

FOREIGN PATENT DOCUMENTS

JP H04305456 A 10/1992
JP H05254108 A 10/1993
(Continued)

OTHER PUBLICATIONS

Office Action for Japanese Application No. 2018-567777 dated Oct. 6, 2020; 21pp.
(Continued)

*Primary Examiner* — Thomas M Wittenschlaeger
(74) *Attorney, Agent, or Firm* — Hauptman Ham, LLP

(57) ABSTRACT

A box making machinery and a corrugated board running register method, include a feeding unit, a processing apparatus which carries out processing on a corrugated board, a running register device which adjusts the processing position of the processing device in a carrying direction of the corrugated board, and a control device which controls the running register device, wherein the control device includes a carrying misalignment amount calculation unit which calculates the carrying misalignment amount of the corrugated board from the feeding unit to a preset predetermined carrying position, and a control unit which adjusts the processing position of the corrugated board to be processed next using the running register device on the basis of the
(Continued)

carrying misalignment amount after processing of the corrugated board has finished.

10 Claims, 7 Drawing Sheets

(51) Int. Cl.

| | |
|---|---|
| ***B31B 50/14*** | (2017.01) |
| ***B31B 50/22*** | (2017.01) |
| ***B31B 50/25*** | (2017.01) |
| ***B31B 50/58*** | (2017.01) |
| ***B31B 50/88*** | (2017.01) |
| ***B31B 50/94*** | (2017.01) |
| ***B65H 3/06*** | (2006.01) |
| ***B65H 5/06*** | (2006.01) |
| *B31B 100/00* | (2017.01) |
| *B31B 120/30* | (2017.01) |
| *B31B 110/35* | (2017.01) |
| *B31B 120/70* | (2017.01) |
| *B31B 50/06* | (2017.01) |

(52) U.S. Cl.
CPC ..... *B31B 50/22* (2017.08); *B31B 50/256* (2017.08); *B31B 50/58* (2017.08); *B31B 50/88* (2017.08); *B31B 50/94* (2017.08); *B65H 3/063* (2013.01); *B65H 5/062* (2013.01); *B31B 50/062* (2017.08); *B31B 2100/002* (2017.08); *B31B 2110/35* (2017.08); *B31B 2120/302* (2017.08); *B31B 2120/70* (2017.08)

(58) Field of Classification Search
CPC ..... B31B 50/94; B31B 50/146; B31B 50/22; B31B 50/256; B31B 50/042; B31B 50/58; B31B 50/88; B31B 50/062; B31B 2110/35
See application file for complete search history.

(56) References Cited

U.S. PATENT DOCUMENTS 4,618,391 A * 10/1986 Torti ..... B23D 36/0058 156/353
4,657,236 A * 4/1987 Hirakawa ..... B65H 3/085 271/10.03
4,774,446 A * 9/1988 Salazar ..... G07B 17/00467 101/233
4,847,775 A * 7/1989 Roch ..... B41F 13/025 700/125
5,000,725 A * 3/1991 Bauknecht ..... B26D 5/00 226/32
5,018,718 A * 5/1991 Matsuno ..... G03G 15/165 271/227
5,036,764 A * 8/1991 Rodi ..... B41F 33/16 101/211
5,103,733 A * 4/1992 Drapatsky ..... B41F 33/16 101/232
5,213,036 A * 5/1993 Tokuno ..... B41F 21/00 101/232
5,398,603 A * 3/1995 Hartmann ..... B41F 13/0045 101/183
5,451,042 A * 9/1995 Cuir ..... B65H 3/063 271/112
5,606,913 A * 3/1997 Kowalewski ..... B41F 19/00 101/183
5,732,944 A * 3/1998 Mayer ..... B65H 29/06 198/459.8
5,924,362 A * 7/1999 Volz ..... B41F 13/0045 101/183
6,059,705 A * 5/2000 Ruthenberg ..... B31B 50/00 493/11
6,220,158 B1 * 4/2001 Hartmann ..... B41F 33/14 101/248
6,273,313 B1 * 8/2001 Noll ..... B65H 45/10 226/30
6,609,462 B2 * 8/2003 Hauck ..... B41F 21/00 101/171
6,823,792 B2 * 11/2004 Grutzmacher ..... B41F 13/0045 101/181
9,033,599 B2 * 5/2015 Kodama ..... B41F 13/025 400/76
2001/0043816 A1 * 11/2001 Dreher ..... B41F 13/12 399/45
2013/0184134 A1 * 7/2013 Suzuki ..... B41F 19/008 493/53
2014/0037353 A1 * 2/2014 Kodama ..... B31B 50/88 400/76
2018/0029244 A1 2/2018 Yamamuro et al.

FOREIGN PATENT DOCUMENTS

JP H06135600 A 5/1994
JP H09165124 A 6/1997
JP 2000255039 A 9/2000
JP 2004058536 A 2/2004
JP 2004107024 A 4/2004
JP 2005324899 A 11/2005
JP 2010149420 A 7/2010
JP 2014030950 A 2/2014
JP 5911142 B2 4/2016
JP 2016150407 A 8/2016
JP 2018108684 A 7/2018

OTHER PUBLICATIONS

International Search Report and Written Opinion for International Application No. PCT/JP2017/035052 dated Dec. 12, 2017; 12pp.
Office Action for Japanese Application No. 2018-567777 dated Jan. 14, 2020; 13 pp.
Extended European Search Report for European Application No. 17918693.7 dated Aug. 9, 2019; 7pp.
Office Action for Japaense Application No. 2018-567777 dated Jun. 29, 2021; 16pp.

* cited by examiner

BOX MAKING MACHINERY AND METHOD FOR ADJUSTING PROCESSING POSITION OF CORRUGATED BOARDS

RELATED APPLICATIONS

The present application is a National Phase of International Application Number PCT/JP2017/035052 filed Sep. 27, 2017.

TECHNICAL FIELD

The present invention relates to a box making machinery which manufactures cardboard boxes by processing corrugated boards into flat shapes, and a method for adjusting the processing position of the corrugated boards, in which the processing position of the corrugated boards processed by the box making machinery is adjusted.

BACKGROUND ART

Typical box making machineries manufacture cardboard boxes by processing corrugated boards into flat shapes, and comprise a feeding unit, a printing unit, a slotter and creaser unit, a diecut unit, a folding unit, a counter ejector unit, and so on. With this box making machinery, the feeding unit can feed the bottommost corrugated board, in a plurality of corrugated boards which are stacked on a table, one at a time to carry the corrugated boards at a fixed speed to the printing unit.

Incidentally, the feeding unit feeds the plurality of corrugated boards which are stacked on the table by means of a plurality of rolls which turn and touch the bottom most corrugated board. When this happens, outer surfaces of the plurality of rolls come in contact with the top and bottom surfaces of the corrugated boards, and therefore the outer surfaces of the rolls become worn due to sliding between these top and bottom surfaces. When the degree of wear on the outer surfaces of the rolls grows large, the outer diameter thereof becomes smaller and the rotational velocity falls, resulting in a drop in the carrying speed of the corrugated boards. When the carrying speed of the corrugated boards falls, the printing unit, for example, becomes unable to print on predetermined locations on the corrugated boards, causing a drop in printing quality of the corrugated boards due to misalignment of the printing locations.

One example of a technology for minimizing the occurrence of misalignment of processing positions on corrugated boards is described in Patent Literature 1 below. In the box making machinery for corrugated boards described in Patent Literature 1, a processing roll drive motor is controlled such that a predetermined rotational position of the processing roll which carries out groove formation, crease creation, or printing on the corrugated boards on the basis of the carrying positions of the corrugated boards as detected by carrying position detection sensors matches predetermined processing positions on the corrugated boards which are being carried.

PRIOR ART LITERATURE

Patent Literature

Patent Literature 1: JP 2010-149420 A

SUMMARY OF THE INVENTION

Problems to be Solved by the Invention

With the technology described in Patent Literature 1 described above, the carrying position of the corrugated board is detected during processing of the corrugated board, and the processing position by a processing device is adjusted relative to the carrying position of the corrugated board. However, if the corrugated board is being carried at a predetermined speed, high precision detectors and control equipment are needed to adjust the processing position by the processing device by detecting the carrying position, which increases equipment costs. On the other hand, control must constantly be carried out of the drive motors for the processing rolls such that predetermined rotational positions of the processing rolls match predetermined processing positions on the corrugated boards which are being carried. Therefore, it is difficult to use a high speed for the carrying speed of the corrugated boards, which results in a drop in productivity.

The present invention solves these problems, and has as an object to provide a box making machinery and a method for adjusting processing positions of corrugated boards, which improve quality by minimizing carrying delays of corrugated boards by a feeding unit while minimizing increases in equipment costs and decreases in productivity.

Means for Solving the Problems

A box making machinery according to the present invention for achieving the aforementioned object is a box making machinery including a paper feeding device including sheet feeding rolls which feed by coming in contact with at least either a top surface or a bottom surface of a corrugated board, a processing device including processing rolls which carry out processing on the corrugated board which has been fed by the paper feeding device, a running register device which adjusts a processing position of the processing device in the carrying direction of the corrugated board, and a control device which controls the running register device, wherein the control device includes a carrying misalignment amount calculation unit which calculates a carrying misalignment amount of the corrugated board from the paper feeding device to a preset predetermined carrying position, and a control unit which adjusts the processing position of the corrugated board which is to be processed next using the running register device on the basis of the carrying misalignment amount after processing of the corrugated board is finished.

Accordingly, the carrying misalignment amount of the corrugated board from the paper feeding device to the predetermined carrying position is calculated by the carrying misalignment amount calculation unit, and the control unit adjusts the processing position of the corrugated board which is to be processed next using the running register device on the basis of the carrying misalignment amount after the corrugated board has been processed. Therefore, when processing the corrugated board, the carrying misalignment amount which has been found during processing of the corrugated board previously is used to adjust the processing position using the processing device ahead of time, which eliminates the need for high precision detectors or control equipment and can therefore minimize increases in equipment costs and can minimize drops in productivity by making it possible to carry the corrugated board at high speeds.

With the box making machinery according to the present invention, an actual arrival pulse calculation unit which calculates an actual arrival pulse produced accompanying rotation of the paper feed roll from the paper feeding device to the predetermined carrying position is provided, and the carrying misalignment amount calculation unit calculates the carrying misalignment amount of the corrugated board by comparing a preset reference arrival pulse and the actual arrival pulse from the paper feeding device to the predetermined carrying position.

Accordingly, the actual arrival pulse calculation unit calculates the actual arrival pulse from the paper feeding device to the predetermined carrying position of the corrugated board which has been fed, and the carrying misalignment amount calculation unit calculates the carrying misalignment amount of the corrugated board by comparing the actual arrival pulse with the reference arrival pulse from the paper feeding device to the predetermined carrying position, and the control unit adjusts the processing position of the corrugated board which is to be processed next using the running register device on the basis of the carrying misalignment amount after processing of the corrugated board is finished. Therefore, the carrying misalignment amount of the corrugated board can be calculated with high precision. Moreover, even if the carrying speed falls for some reason, the intervals between occurrences of pulses will drop in a similar fashion, allowing accurate calculation of the pulse.

With the box making machinery according to the present invention, an actual arrival pulse calculation unit which calculates an actual arrival pulse produced accompanying rotation of the processing roll from the paper feeding device to the predetermined carrying position is provided, and the carrying misalignment amount calculation unit calculates the carrying misalignment amount of the corrugated board by comparing a preset reference arrival pulse and the actual arrival pulse from the paper feeding device to the predetermined carrying position.

Accordingly, the actual arrival pulse calculation unit calculates the actual arrival pulse from the paper feeding device to the predetermined carrying position of the corrugated board which has been fed, and the carrying misalignment amount calculation unit calculates the carrying misalignment amount of the corrugated board by comparing the actual arrival pulse with the reference arrival pulse from the paper feeding device to the predetermined carrying position, and the control unit adjusts the processing position of the corrugated board which is to be processed next using the running register device on the basis of the carrying misalignment amount after processing of the corrugated board is finished. Therefore, the carrying misalignment amount of the corrugated board can be calculated with high precision. Moreover, even if the carrying speed falls for some reason, the intervals between occurrences of pulses will drop in a similar fashion, allowing accurate calculation of the pulse.

With the box making machinery according to the present invention, an actual arrival time calculation unit which calculates an actual arrival time from the paper feeding device to the predetermined carrying position is provided, and the carrying misalignment amount calculation unit calculates the carrying misalignment amount of the corrugated board by comparing the actual arrival time with a preset reference arrival time from the paper feeding device to the predetermined carrying position. Furthermore, even if sliding occurs between the sheet feeding rolls and the corrugated board, the actual arrival time can be measured accurately.

Accordingly, the actual arrival time calculation unit calculates the actual arrival time of the corrugated board fed by the paper feeding device to the predetermined carrying position, the carrying misalignment amount calculation unit calculates the carrying misalignment amount of the corrugated board by comparing the actual arrival time with the reference arrival time from the paper feeding device to the predetermined carrying position, and the control unit adjusts the processing position of the corrugated board which is to be processed next using the running register device on the basis of the carrying misalignment amount after processing of the corrugated board has been finished. Therefore, the carrying misalignment amount of the corrugated board can be calculated with high precision.

With the box making machinery according to the present invention, when processing a predetermined number of corrugated boards of the same type, the carrying misalignment amount calculation unit calculates an average value of the carrying misalignment amount for the predetermined number of corrugated boards, and the control unit adjusts the processing position of the corrugated board to be processed next using the running register device on the basis of the average value of the carrying misalignment amount.

Accordingly, the carrying misalignment amount calculation unit calculates the average value of the carrying misalignment amount of the predetermined number of corrugated boards, and the control unit adjusts the processing position of the corrugated board which is to be processed next on the basis of the average value of the carrying misalignment amount, and therefore adjusts the processing position of the corrugated board on the basis of the average value, meaning that even if there is variation among the calculated carrying misalignment amounts, the processing position of the corrugated board can be adjusted with high precision.

With the box making machinery according to the present invention, a storage unit which stores the carrying misalignment amounts of the corrugated boards which have been calculated by the carrying misalignment amount calculation unit is provided, and when a carrying misalignment amount for a new corrugated board is calculated by the carrying misalignment amount calculation unit, the carrying misalignment amounts stored in the storage unit are updated.

Accordingly, when the carrying misalignment amount calculation unit calculates the carrying misalignment amount for a corrugated board, the carrying misalignment amount for the most recent corrugated board is stored in the storage unit, and the processing position of the corrugated board is adjusted always using the most recent carrying misalignment amount even if the type of cardboard being processed is changed, thereby making it possible to adjust the processing position of the corrugated boards with high precision.

With the box making machinery according to the present invention, a map expressing the carrying misalignment amounts relative to the carrying direction length of the corrugated boards is stored in the storage unit, and the carrying misalignment amount calculation unit calculates the carrying misalignment amount of the corrugated board using the map which is stored in the storage unit.

Accordingly, the carrying misalignment amount calculation unit calculates the carrying misalignment amount for the corrugated board using the map expressing the carrying misalignment amount relative to the carrying direction length of the corrugated board stored in the storage unit, and therefore the carrying misalignment amount can be calculated with high precision.

With the box making machinery according to the present invention, a standard carrying misalignment amount unique to the corrugated board is set, and the control unit adjusts the processing position of the corrugated board which is to be processed next using the running register device on the basis of a caring misalignment amount correction value in which the carrying misalignment amount is added to the standard carrying misalignment amount.

Accordingly, the processing position of the corrugated board to be processed next is adjusted on the basis of the carrying misalignment correction value in which the carrying misalignment value is added to the standard carrying misalignment value, and therefore the processing position of the corrugated board is adjusted with due consideration to the carrying misalignment amount unique to the corrugated board, thereby making it possible to adjust the processing position of a corrugated board S with high precision.

With the box making machinery according to the present invention, a printing unit which carries out printing on the corrugated board and a slotter and creaser unit which applies ruled lines to a surface of the corrugated board and cuts grooves therein are provided as processing devices, and a position detector which detects a corrugated board which is reached the predetermined carrying position is disposed between the printing unit and the slotter and creaser unit.

Accordingly, because the position detector which detects the corrugated board is disposed between the printing unit and the slotter and creaser unit, the corrugated board moving through the space between the printing unit and the slotter and creaser unit can be to detected with great precision if the position detector is an optical sensor, for example.

With the box making machinery according to the present invention, a printing unit which carries out printing on the corrugated board, a paper discharge unit which applies ruled lines to the surface of the corrugated board and cuts grooves therein, a diecut unit which performs punching in the corrugated board, a folding unit which forms a cardboard box into a flat shape by folding the corrugated boards and joining edges thereof, and a counter ejector unit which counts the cardboard boxes and discharges a predetermined number thereof after being stacked are provided, and the running register device adjusts the processing positions of the printing unit, the slotter and creaser unit, and the diecut unit.

Accordingly, the control unit adjusts the position where the corrugated board is printed on, the position where grooves are cut into the corrugated board, and the position where the corrugated board is punched on the basis of the carrying misalignment of the corrugated board, thereby making it possible to improve the processing precision of the corrugated board.

Furthermore, a corrugated board running register method according to the present invention includes calculating a carrying misalignment amount of a corrugated board from a paper feeding position to a preset predetermined carrying position, and adjusting a processing position of the corrugated board which is to be processed next on the basis of the carrying misalignment amount after processing of the corrugated board is finished.

Accordingly, when processing the corrugated board, the carrying misalignment amount found when processing the previous corrugated board is used to adjust the processing position by the processing device ahead of time, eliminating the need for high precision detectors and control equipment, which can minimize increases in equipment costs and also minimize drops in productivity by making it possible to use a high speed for carrying the corrugated board.

Effects of the Invention

With the box making machinery and the method for adjusting the processing position of the corrugated board according to the present invention, high precision detectors and control equipment are unneeded, increases in equipment costs can be minimized, and drops in productivity can be minimized by making it possible to carry corrugated boards at high-speed.

EMBODIMENTS FOR CARRYING OUT THE INVENTION

Preferable embodiments of a box making machinery and corrugated board running register method according to the present invention are described in detail below, with reference to the attached drawings. Note that the present invention is not limited by these embodiments, and includes configurations of combinations of the embodiments if there are a plurality of embodiments.

Figure 1:
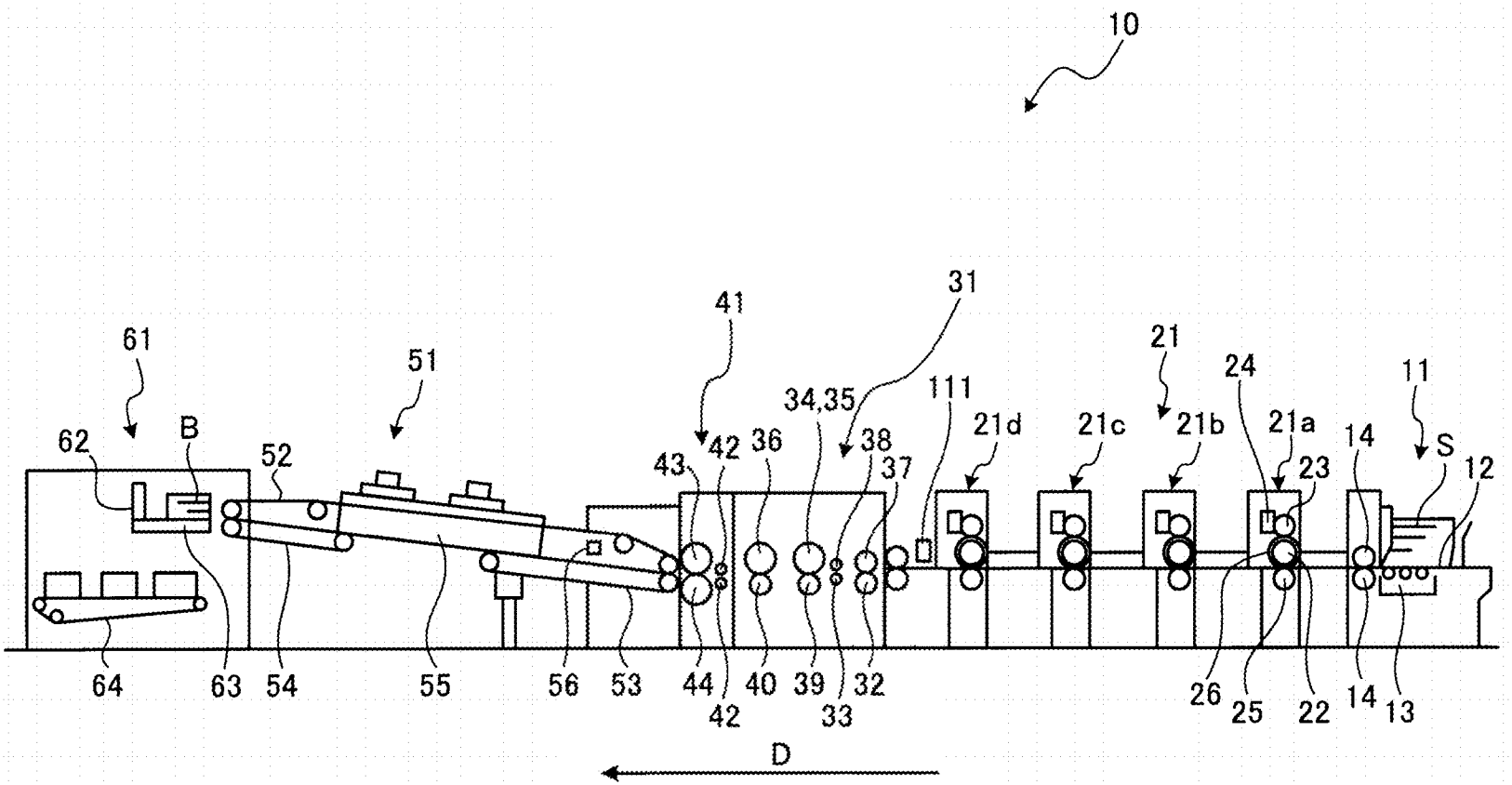
FIG. 1 is a schematic configuration view showing a box making machinery according to the present embodiment.

FIG. 1 is a schematic configuration view showing a box making machinery according to the present embodiment.

In the present embodiment, as shown in FIG. 1, a box making machinery 10 manufactures a cardboard box B in a flat shape by processing corrugated boards S. The corrugated boards S are formed by gluing a corrugated core between a surface liner and the rear liner. The box making machinery 10 is provided with a feeding unit 11, a printing unit 21, slotter and creaser unit 31, a diecut unit 41, a folding unit 51, and a counter ejector unit 61 which are arranged in a straight line in a direction (hereafter, carrying direction) D along which the corrugated board S and the cardboard box B are carried.

The feeding unit 11 feeds one of the corrugated boards S which has been stacked in a vertical direction at a time to the printing unit 21 at a fixed speed. The feeding unit 11 has a feeding table 12, a sheet feeding mechanism 13, and a feed roll 14. On the feeding table 12, a plurality of the corrugated boards S can be stacked and mounted. The sheet feeding mechanism 13 is configured such that a plurality of feeding rolls are disposed below the corrugated boards S, allowing forward feeding of the corrugated board S which is in the bottom most position of the plurality of corrugated boards S which are supported on the feeding table 12. The feed roll 14 can feed the corrugated board S which has been fed by the feeding roll to the printing unit 21.

The printing unit 21 carries out multicolor printing (four-color printing in the present embodiment) on the surface (top surface) of the corrugated board S. The printing unit 21 has four printing units 21*a*, 21*b*, 21*c*, and 21*d* arranged in a horizontal line, able to print on the surface of the corrugated board S using four ink colors. The printing units 21*a*, 21*b*, 21*c*, and 21*d* are similarly configured, having a printing cylinder 22, an ink supply roll (an anilox roll) 23, and ink chamber 24, and a bearing roll 25. The printing cylinder 22 has a printing plate 26 attached to an outer circumferential section thereof and is provided in a manner so as to allow turning. The ink supply roll 23 is disposed so as to be in contact with the printing plate 26 near the printing cylinder 22, and is provided in a manner so as to allow turning. The ink chamber 24 stores ink, and is provided near the ink supply roll 23. The bearing roll 25, with the printing cylinder 22, sandwiches the corrugated board S, thereby carrying it by applying a predetermined printing pressure thereto and is provided below the printing cylinder 22 in a manner so as to allow turning. Note that, while not shown in the drawings, the printing units 21*a*, 21*b*, 21*c*, and 21*d* are provided with pairs of vertically arranged feeding rolls before and after.

The slotter and creaser unit 31 has a slotter device, and applies ruled lines and cuts grooves in the corrugated board S. The slotter and creaser unit 31 has primary creaser primary creaser rolls 32, second ruled line rolls 33, a slitter head 34, first slotter heads 35, and second slotter heads 36.

The primary creaser rolls 32 are formed with a circular shape, arranged in a plurality (four in the present embodiment) at fixed intervals in the horizontal direction at a right angle to the carrying direction D of the corrugated board S, and can be turned by a drive device which is not shown in the drawings. The second ruled line rolls 33 are formed with a circular shape, arranged in a plurality (four in the present embodiment at fixed intervals in the horizontal direction at a right angle to the carrying direction D of the corrugated board S, and can be turned by a drive device which is not shown in the drawings. In this case, the primary creaser rolls 32 which are disposed below apply ruled lines to the rear surface (bottom surface) of the corrugated board S, and the second ruled line rolls 33 which are disposed below apply ruled lines to the rear surface (bottom surface) of the corrugated board S, like the primary creaser rolls 32. The bearing rolls 37 and 38 are provided in a manner allowing synchronized turning to positions above corresponding to the ruled line rolls 32 and 33.

The slitter head 34 and the first slotter heads 35 are formed with a circular shape, arranged in a plurality (five in the present embodiment) at fixed intervals in the horizontal direction at a right angle to the carrying direction D of the corrugated board S, and can be turned by drive device which is not shown in the drawings. The slitter head 34 is constituted by one unit which is provided corresponding to an end of a width direction in the corrugated board S which is being carried and can cut the end of the width direction in the corrugated board S. The first slotter heads 35 are constituted by four units which are provided corresponding to predetermined positions in the width direction of the corrugated board S which is being carried, and are able to cut grooves and create paste pieces in predetermined positions in the corrugated board S. The second slotter heads 36 are constituted by four units, which are provided corresponding to predetermined positions in the width direction of the corrugated board S which is being carried, and are able to cut grooves and create paste pieces in predetermined positions in the corrugated board S. In this case, the slitter had 34 and the first slotter heads 35 are provided in a manner such that bottom heads 39 turn in sync therewith in corresponding lower positions, and the second slotter heads 36 are provided in a manner such that bottom heads 40 turning in sync therewith in corresponding lower positions.

The diecut unit 41 punches hand holes and the like in the corrugated board S. The diecut unit 41 has a pair of vertical moving pieces 42, and an anvil cylinder 43, and a knife cylinder 44. The moving pieces 42 sandwich the corrugated board S from above and below and carry it, and are provided in a manner allowing rotation. The anvil cylinder 43 and the knife cylinder 44 are formed with circular shapes, and can be turned in sync with one another by a drive device which is not shown in the drawings. In this case, the anvil cylinder 43 has an anvil formed on its outer circumference, and the knife cylinder 44 is provided with a blade attachment platform (a punching blade) to a predetermined location on its outer circumference.

The folding unit 51 forms a flat cardboard box B by folding the corrugated board S while moving it in the caring direction D and joining width-direction ends thereof. The folding unit 51 has a top carrying belt 52, bottom carrying belts 53 and 54, and a shaping device 55. The top carrying belt 52 and the bottom carrying belts 53 and 54 sandwich the corrugated board S and the cardboard box B from above and below and carry them. The shaping device 55 has a pair of left and right shaping belts which fold width-direction ends of the corrugated board S by folding them downward. The folding unit 51 is provided with a glue application device 56. The glue application device 56 has a glue gun and can apply glue to predetermined locations in the corrugated board S by ejecting glue at a predetermined timing.

The counter ejector unit 61 counts the cardboard boxes B while stacking them and then separates them into batches of predetermined numbers and discharges them. The counter ejector unit 61 has a hopper device 62. The hopper device 62 has an elevator 63 which can ascend and descend on which the cardboard boxes B are stacked, and a front abutting plate and corner aligning plates which are not shown in the drawings are provided to the elevator 63 as arranging means. Note that a discharge conveyor 64 is provided below the hopper device 62.

A plurality of the corrugated boards S are stacked in the vertical direction on the feeding table 12 of the feeding unit 11. With the feeding unit 11, the bottommost of the plurality of the corrugated boards S which are stacked on the feeding table 12 is fed forward by the sheet feeding mechanism 13. Once this happens, the corrugated board S is fed towards the printing unit 21 at a predetermined fixed speed by feed rolls 14.

In the printing unit 21, ink is supplied from the ink chambers 24 to the surface of the ink supply roll 23 in the printing units 21*a*, 21*b*, 21*c*, and 21*d*, and when the printing cylinder 22 and the ink supply roll 23 turned, the ink on the surface of the ink supply roll 23 is transferred to the printing plate 26. When the corrugated board S is carried between the printing cylinder 22 and the bearing roll 25, the corrugated board S is sandwiched between the printing plate 26 and the bearing roll 25, and printing pressure is applied to the corrugated board S so as to print on the surface thereof. The corrugated board S thus printed on is carried to the slotter and creaser unit 31 by the feed rolls.

In the slotter and creaser unit 31, when the corrugated board S passes through the primary creaser rolls 31, ruled lines are formed on the rear liner on the rear surface of the corrugated board S. When the corrugated board S passes through the second ruled line rolls 33, ruled lines are once again formed on the rear liner on the rear surface of the corrugated board S, like with the primary creaser rolls 32. Next, the corrugated board S passes through the slitter head 34, one end in the width direction is cut. When the corrugated board S passes through the first slotter heads 35, grooves are formed in positions upstream of the ruled lines. When this happens, the other end in the width direction is cut. When the corrugated board S passes through the second slotter heads 36, grooves are formed in positions downstream of the ruled lines. When this happens, the other and in the width direction is caught, and paste pieces (joining pieces) are formed. Thereafter, the corrugated board S on which the ruled lines have been formed and in which the grooves have been cut is sent to the diecut unit 41.

In the diecut unit 41, when the corrugated board S passes between the anvil cylinder 43 and the knife cylinder 44, a hand hole (not shown in the drawings) is formed. However, forming the hand hole is done as appropriate according to the type of the corrugated board S, and if there is no need for a hand hole, the blade attachment platform (punching blade) for forming the hand hole is removed from the knife cylinder 44, and the corrugated board S passes between the anvil cylinder 43 and the knife cylinder 44 which turn. The corrugated board S in which the hand hole has been formed is carried to the folding unit 51.

In the folding unit 51, the corrugated board S is moved in the caring direction D by the top carrying belt 52 and the bottom carrying belts 53 and 54, and glue is applied by the glue application device 56 using the paste pieces, and the corrugated board S is folded downward along the ruled lines by the shaping device 55. Once the folding has almost reached 180°, the folding strength increases causing the ends of the corrugated board S which overlap with the paste pieces to be pressed closely against the paste pieces, thereby resulting in both ends of the corrugated board S being joined together, forming the cardboard box B. The cardboard box B is carried to the counter ejector unit 61.

In the counter ejector unit 61, the cardboard box B which has been detected as being free from defects is sent to the hopper device 62. The front edge in the carrying direction D of the cardboard box B which has been sent to the hopper device 62 abuts the front abutting plate and is stacked on the elevator 63 aligned by the corner alignment plates. Once the predetermined number of cardboard boxes B has been stacked on the elevator 63, the elevator 63 descends, and the predetermined number of the cardboard boxes B is discharged onto a carrying conveyor 64 as a single batch, and sent to a later step after the box making machinery 10.

Figure 2:
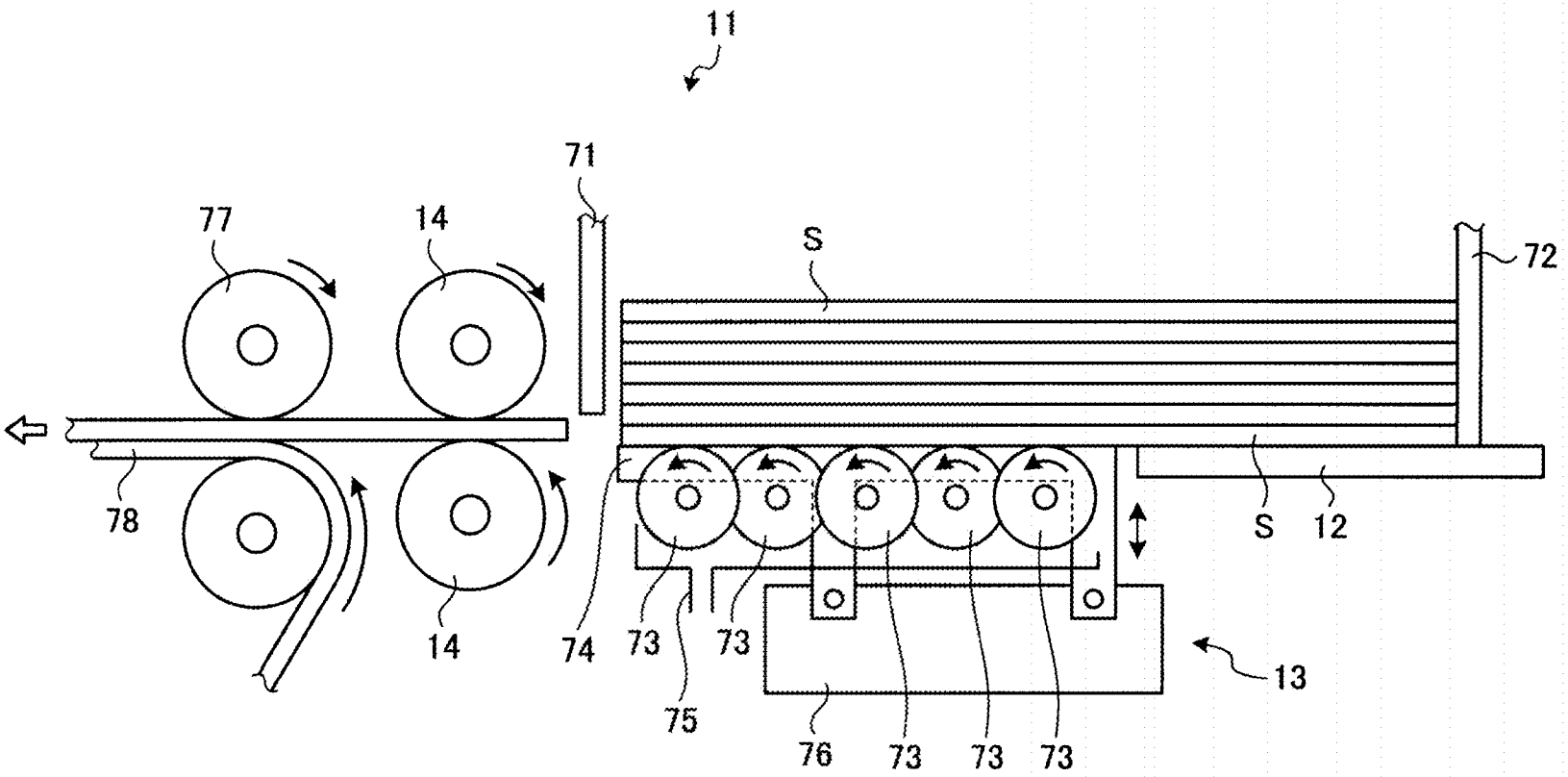
FIG. 2 is a schematic configuration view showing a feeding unit.

The feeding unit 11 in the box making machinery 10 according to the present embodiment described above is described now in detail. FIG. 2 is a schematic configuration view showing a feeding unit.

As shown in FIG. 2, the paper feeding device 11, as described above, has the feeding table 12, the sheet feeding mechanism 13, and the feed rolls (sheet feeding rolls) 14. The sheet feeding mechanism 13 has a front guide 71, a backstop 72, a plurality of feeding rolls (sheet feeding rolls) 73, a glate plate 74 in the form of a grid, and a suction device 75. The front guide 71 is disposed in front of the feeding table 12, and can position the front edge position of a plurality of the corrugated boards S which has been stacked on the feeding table 12, creating a gap between the bottom edge and the top surface of the feeding table 12 through which one of the corrugated boards S can pass. The backstop 72 is disposed behind the feeding table 12, and can position the rear edge position of the plurality of corrugated boards S which are stacked on the feeding table 12. Note that the width direction position of the corrugated boards S on the feeding table 12 is restricted by a side guide, although this is not shown in the drawings.

The plurality of feeding rolls 73 are disposed below the corrugated boards S which are supported on the feeding table 12 in the carrying direction D and the width direction of the corrugated boards S. The plurality of feeding rolls 73 can be turned via drive device (not shown in the drawings), and the rotational speed can be increased and decreased. The glate plate 74 is disposed so as to form a grid shape between the plurality of feeding rolls 73, and can be raised and lowered by an elevator mechanism 76. Specifically, when the elevator mechanism 76 puts the glate plate 74 in a raised position, the bottom surface of the corrugated board S moves away from the feeding rolls 73, and when the elevator mechanism 76 puts the glate plate 74 in a lowered position, the bottom surface of the corrugated board S comes in contact with the feeding rolls 73, and the corrugated board S can be fed forward. The suction device 75 sucks the corrugated boards S which are stacked downward, i.e., towards the feeding table 12 and the feeding rolls 73.

The pair of upper and lower feed rolls 14 are disposed downstream of the front guide 71 in the carrying direction D, and can be turned by a drive device (not shown in the drawings). The feed rolls 14 sandwich the corrugated board S which has been fed from the feeding table 12 by the feeding rolls 73 from above and below, and can carry the corrugated board S towards the printing unit 21. Furthermore, the feed rolls 14 have an upper carrying roll (sheet feeding roll) 77 and the lower carrying conveyor 78 provided downstream in the carrying direction D. The upper carrying roll 77 and the lower carrying conveyor 78 sandwich the corrugated board S together with the feed rolls 14 from above and below and carry it towards the printing unit 21.

Therefore, when the glate plate 74 is lowered by the elevator mechanism 76, the plurality of feeding rolls 73 which are turning come in contact with the bottom surface of the corrugated board S which is in the bottom most position of the plurality of corrugated boards S which is supported on the feeding table 12. Hence, this corrugated board S is fed forward from the plurality of feeding rolls 73, and is accelerated to a predetermined speed. The corrugated board S which has been fed forward is supplied to the printing unit 21 (see FIG. 1) by the pair of upper and lower feed rolls 14, the upper carrying roll 77, and the lower carrying conveyor 78. On the other hand, once the corrugated board S has been fed out of the paper carrying table 12, the glate plate 74 is raised by the elevator mechanism 76, and supported such that the bottom surface of the next corrugated board S does not come in contact with the plurality of feeding rolls 73.

Incidentally, the feeding unit 11 is such that the plurality of feeding rolls 73 come in contact with the bottom surface of the corrugated board S on the feeding table 12 and feed it forward, and the feed rolls 14, the upper carrying roll 77, and the lower carrying conveyor 78 carry the corrugated board S to the printing unit 21. Therefore, the outer circumferential surfaces of the feeding rolls 73, the feed rolls 14, and the upper carrying roll 77, which serve as sheet feeding rolls, gradually wear down, with the result that the outer diameter grows smaller and the circumferential speed falls, which causes the feeding speed of the corrugated board S to fall. When this happens, carrying of the corrugated board S from the feeding unit 11 to the printing unit 21 is delayed, and the printing unit 21 has difficulty printing on the predetermined locations of the corrugated board S.

Accordingly, in the present embodiment, even if wear occurs on the feeding rolls 73, the feed rolls 14, and the upper carrying roll 77 in the feeding unit 11 and carrying delays occur from the feeding unit 11 to the printing unit 21, a carrying delay amount (the carrying misalignment amount) can be corrected, making it possible to print in the predetermined positions of the corrugated board S by the printing unit 21.

Figure 3:
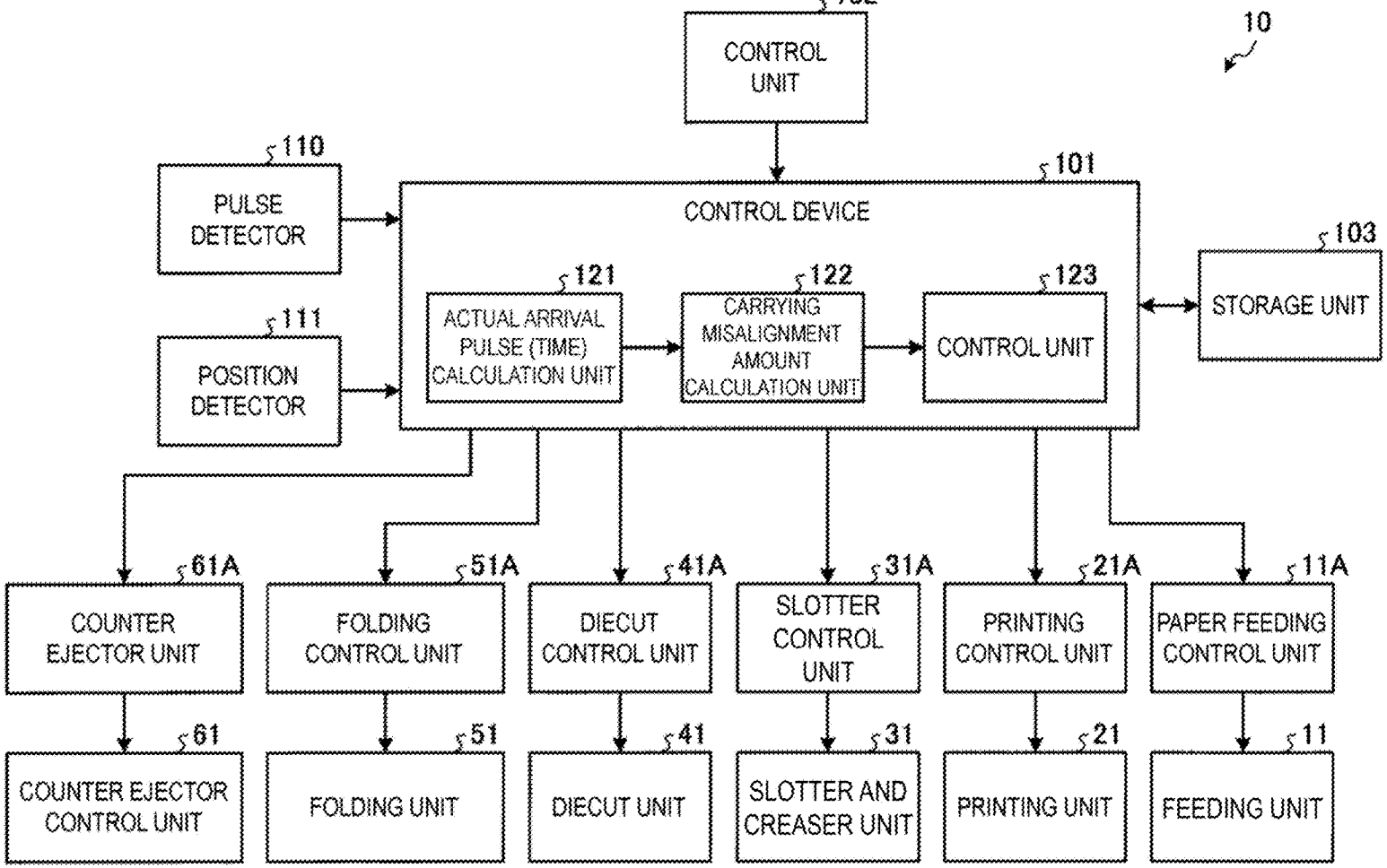
FIG. 3 is a block diagram showing a control system in the box making machinery.

FIG. 3 is a block diagram showing a control system in the box making machinery.

The box making machinery 10 of the present embodiment, as shown in FIG. 3, is provided with a control device 101 in addition to the feeding unit 11, the printing unit 21, the slotter and creaser unit 31, the diecut unit 41, the folding unit 51, and the counter ejector unit 61. The feeding unit 11, the printing unit 21, the slotter and creaser unit 31, the diecut unit 41, the folding unit 51, and the counter ejector unit 61 are connected to a paper feeding control unit 11A, a printing control unit 21A, a slotter control unit 31A, a diecut control unit 41A, a folding control unit 51A, and a counter ejector control unit 61A, respectively. The control device 101 is connected to the paper feeding control unit 11A, the printing control unit 21A, the slotter control unit 31A, the diecut control unit 41A, the folding control unit 51A, and the counter ejector control unit 61A.

The control device 101 is connected to an operating unit 102. The operating unit 102 can be operated by an operator and allows input of various types of job data. Furthermore, the control device 101 is connected to a storage unit 103. The storage unit 103 can store various types of job data which are input via the operating unit 102. The control device 101 is connected to a pulse detector 110 and a position detector 111. The pulse detector 110 is a rotary encoder, which, for example counts pulses generated as a motor constituting the drive device of the feeding rolls 73 turns or pulses generated as a motor constituting a drive device of the primary creaser rolls 32 or bearing rolls 37, etc. as processing rolls turn, and outputs a pulse count to the control device 101. The position detector 111 is an optical sensor, such as a photoelectric tube, which is disposed between the printing unit 21 and the slotter and creaser unit 31 and detects the corrugated boards S which are carried, and outputs detection results to the control device 101.

The control device 101 has an actual arrival pulse calculation unit 121, a carrying misalignment amount calculation unit 122, and a control unit 123. The actual arrival pulse calculation unit 121 detects actual arrival pulses up to a preset predetermined caring position (the detection position of the position detector 111) of the corrugated board S which has been fed from the feeding unit (the paper feeding device) 11. The actual arrival pulse is the actual pulse count from when the front edge of the corrugated board S downstream in the carrying direction D leaves the front guide 71 (see FIG. 2) of the feeding unit 11 and up to when the front edge of the corrugated board S is detected by the position detector 111. The pulse detector 110 counts the pulses generated as the motor of the feeding rolls 73 turns, and the actual arrival pulse calculation unit 121 calculates the actual arrival pulses on the basis of this pulse count and the detection signal for the corrugated board S from the position detector 111.

Note that the present embodiment is not limited to using the pulse detector 110. For example, an actual arrival time calculation unit can be provided instead of the actual arrival pulse calculation unit 121. The actual arrival time calculation unit detects the actual arrival time at a predetermined carrying position of the corrugated board S which has been fed by the feeding unit 11. The actual arrival time is an actual time count from when the front edge of the corrugated board S downstream in the carrying direction D leaves the front guide 71 (see FIG. 2) of the feeding unit 11 up to when the front edge of the corrugated board S is detected by the position detector 111. In this case, for example, a position detector which detects that the front edge of the corrugated board S downstream in the carrying direction D has departed the front guide 71 may be provided to the front guide 71 of the feeding unit 11. The actual arrival time calculation unit calculates the actual arrival time on the basis of the detection signal of the corrugated board S by the two position detectors 111.

The carrying misalignment amount calculation unit 122 calculates the carrying misalignment amount of the corrugated board S by comparing a preset reference arrival pulse (time) from the feeding unit 11 to the predetermined carrying position against the actual arrival pulse (time). The reference arrival pulse (time) is the designed carrying pulse (time) from when the front edge of the corrugated board S leaves the front guide 71 of the feeding unit 11 until the front edge of the corrugated board S is detected by the position detector 111. The control unit 123 adjusts the processing position of the corrugated board S which is to be processed next using the running register device on the basis of the carrying misalignment amount after processing of the corrugated board S is finished.

The processing devices according to the present invention carry out processing on the corrugated board S which has been fed by the feeding unit 11 and are the printing unit 21, the slotter and creaser unit 31, the diecut unit 41, the folding unit 51, and the counter ejector unit 61. The running register devices according to the present embodiment adjust the processing position of the processing devices in the carrying direction D of the corrugated board S, and are the printing control unit 21A, the slotter control unit 31A, and the diecut control unit 41A. Specifically, the printing control unit 21A controls the printing unit 21 to adjust the printing position of the corrugated board S in the carrying direction D. The slotter control unit 31A controls the slotter and creaser unit 31 to adjust the groove cutting position in the carrying direction D in the corrugated board S. The diecut control unit 41A controls the diecut unit 41 to adjust the punching position in the carrying direction D in the corrugated board S.

The method for adjusting the processing position of the corrugated board S using the running register devices is described in detail below. With the printing unit 21, printing is carried out by transferring ink from the printing cylinder 22 which turns onto the corrugated board S, and therefore the rotational phase of the printing cylinder 22 is adjusted. Specifically, the carrying misalignment amount of the corrugated board S is the delay time, and therefore the delay distance is calculated by multiplying this delay time by the carrying speed of the corrugated board S. The delay distance is the carrying misalignment amount correction value which is discussed below. The printing control unit 21A adjusts the rotational phase of the printing cylinder 22 on the basis of the carrying misalignment amount correction value. Furthermore, the slotter control unit 31A adjusts the groove cutting position on the basis of the carrying misalignment amount correction value, and the diecut control unit 41A adjusts the punching position on the basis of the carrying misalignment amount correction value.

When the box making machinery 10 is processed a predetermined number of the same type of the corrugated boards S, the carrying misalignment amount calculation unit 122 calculates the average value of the carrying misalignment value for this predetermined number of the corrugated boards S, and the control unit 123 adjusts the processing position of the corrugated board S which is to be processed next on the basis of the average value of the carrying misalignment amount. In this case, when adjusting the processing position of the corrugated board S which is to be processed next, it is also possible to adjust the processing position of the corrugated board S which is to be processed next on the basis of, for example, the carrying misalignment amount for one of the corrugated boards S immediately before processing is finished or the average value of the carrying misalignment amount for the plurality of corrugated boards S immediately before processing is finished, instead of the average value of the carrying misalignment amount.

Incidentally, the carrying delay amount from when the feeding unit 11 feeds the corrugated board S to the predetermined carrying position (the detection position by the position detector 111) occurs not only because of wear on the feeding rolls 73, etc., but also because of sliding between the corrugated board S and the feeding rolls 73, the feed rolls 14, and/or the upper carrying roll 77. The carrying delay amount resulting from this sliding, etc., varies depending on the type of the corrugated board S (length in the carrying direction D, thickness, material, etc.). Therefore, a standard carrying delay amount is set by calculating the actual arrival pulse (time) from when the leading edge of the corrugated board S leaves the front guide 71 of the feeding unit 11 until the front edge of the corrugated board S is detected by the position detector 111 with the feeding rolls 73, etc., in an unworn, new state, and subtracting this time from the reference arrival pulse (time). In reality, when starting processing of the corrugated boards S, test printing is done using the printing unit 21, at which time the printing misalignment amount is adjusted, and therefore this printing misalignment amount is set as the standard carrying misalignment amount. This standard carrying misalignment amount is set for each type of the corrugated boards S which are processed.

Therefore, the control unit 123 adjusts the processing position of the corrugated board S which is to be processed next using the running register devices on the basis of the carrying misalignment amount correction value which is equal to the carrying misalignment amount calculated by the carrying misalignment amount calculation unit 122 added to the preset standard carrying misalignment amount. At this time, the control unit 123 outputs the carrying misalignment amount correction value to the printing control unit 21A, the slotter control unit 31A, and the diecut control unit 41A, and the printing control unit 21A, the slotter and creaser unit 31A, and the diecut control unit 41A adjust the printing position by the printing unit 21, the groove cutting position by the slotter and creaser unit 31, and the punching position by the diecut unit 41.

Figure 4:
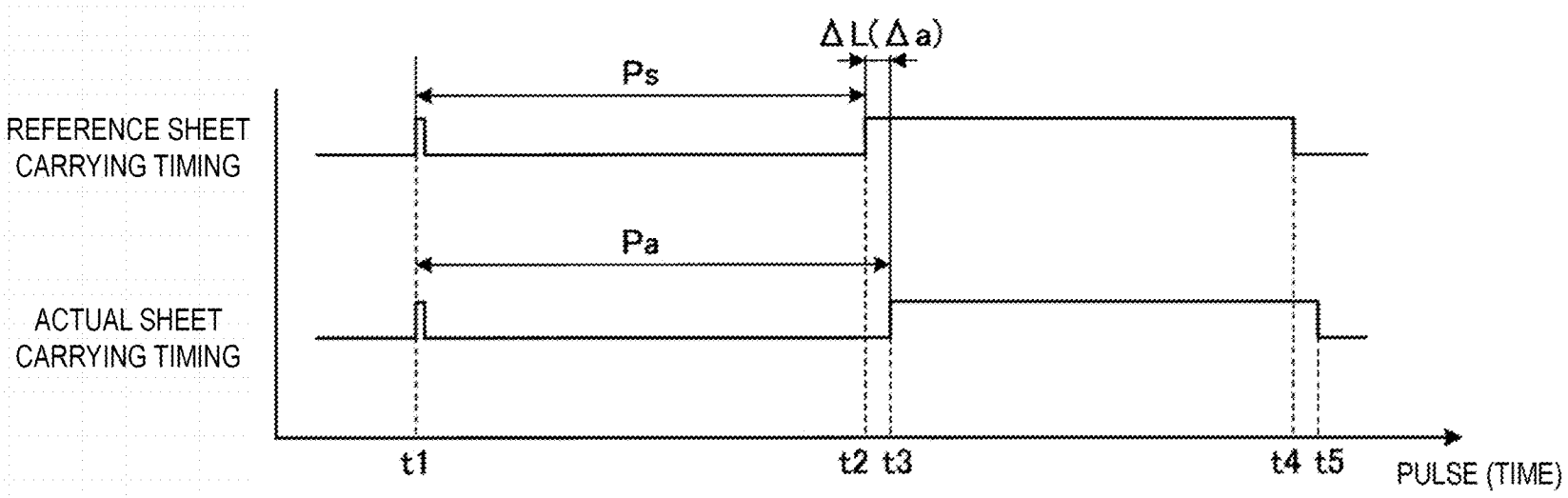
FIG. 4 is a schematic view for describing a carrying misalignment amount because of wear in the feeding unit.
Figure 5:
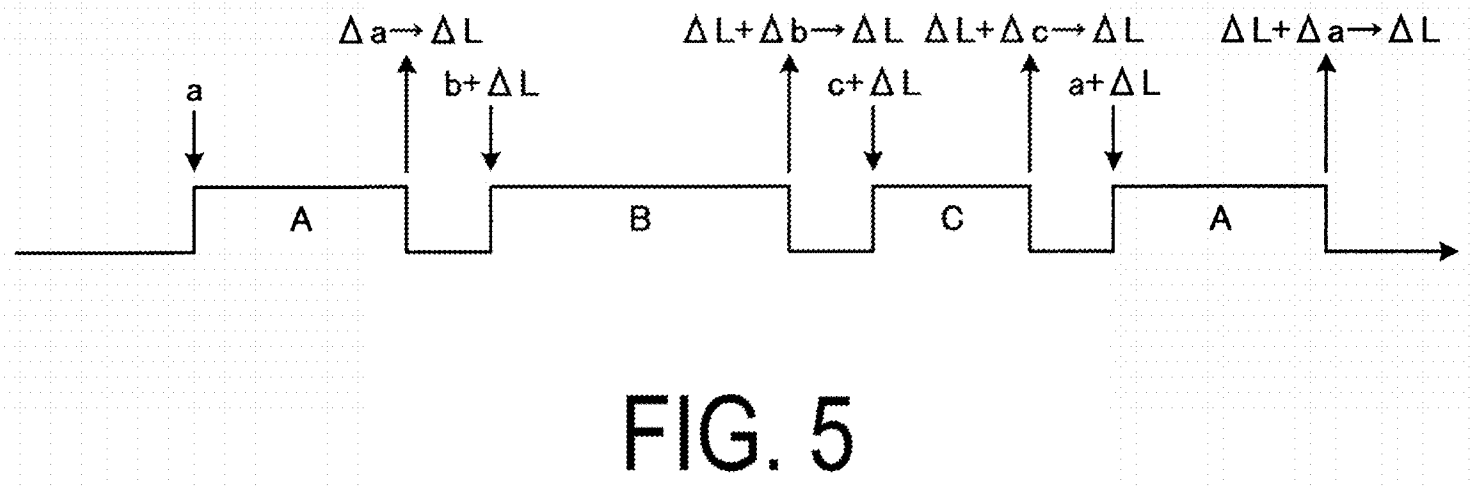
FIG. 5 is a schematic view for describing a method for correcting the carrying misalignment amount in a manufacturing process for different types of corrugated board.
Figure 6:
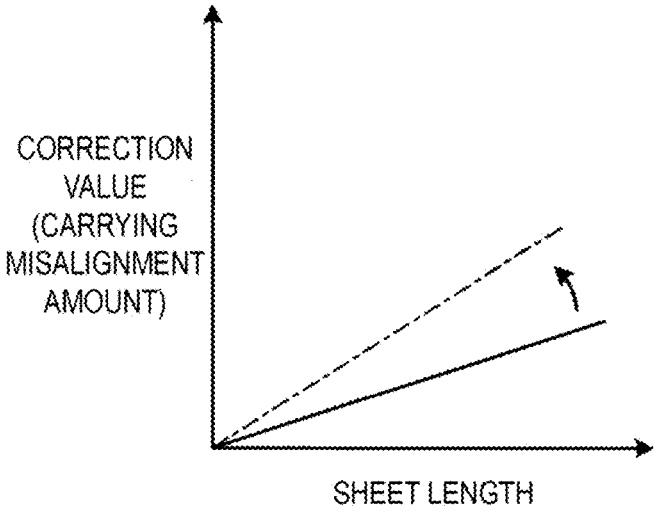
FIG. 6 is a map showing correction amounts (carrying misalignment amounts) relative to sheet lengths of corrugated boards.
Figure 7:
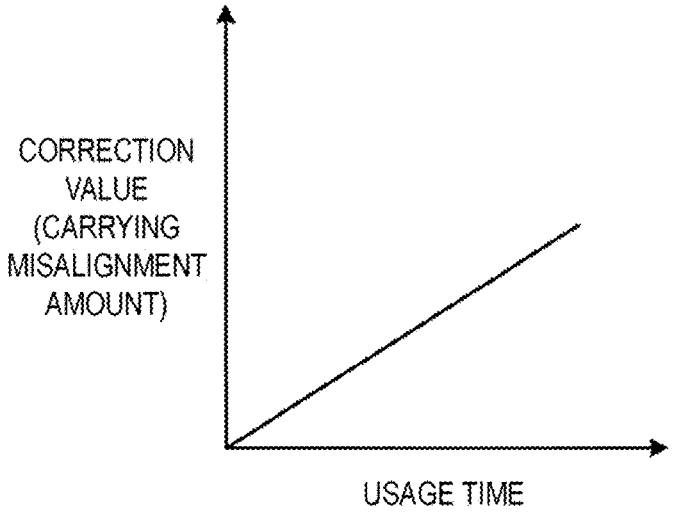
FIG. 7 is a map showing correction amounts (carrying misalignment amounts) relative to usage time of the feeding unit.

A method for adjusting the processing position of the corrugated boards in the box making machinery 10 according to the present embodiment is described in detail now. FIG. 4 is a schematic view for describing carrying misalignment amount because of wear in the feeding unit. FIG. 5 is a schematic view for describing a method for correcting the carrying misalignment amount in a manufacturing process for different types of corrugated board. FIG. 6 is a map showing correction amounts (carrying misalignment amounts) relative to sheet lengths of corrugated boards. FIG. 7 is a map showing correction amounts (carrying misalignment amounts) relative to usage time of the feeding unit.

A method for adjusting the processing position of the corrugated boards according to the present embodiment has a step of calculating the carrying misalignment amount of the corrugated boards S from the paper feeding position to a preset predetermined carrying position, and a step of adjusting the processing position of the corrugated board S to be processed next on the basis of the carrying misalignment amount after processing of the corrugated board S has finished.

As shown in FIG. 3 and FIG. 4, for example, a job is described in which a predetermined number of the corrugated boards S of type A. When the feeding unit 11 is activated and feeds the corrugated board S, the leading edge of the corrugated board S exits the front guide 71 at time t1 and the leading edge of the corrugated board S reaches the predetermined carrying position (the detection position by the position detector 111) at time t2, and the rear edge of the corrugated board S reaches a predetermined carrying position (the detection position by the position detector 111) at time t4, using a reference sheet carrying timing which has been preset by the design ahead of time. Therefore, the pulse count detected during the carrying time of the corrugated board S from time t1 to time t2 is a reference arrival pulse Ps. On the other hand, using an actual sheet carrying timing, the leading edge of the corrugated board S exits the front guide 71 at time t1, the leading edge of the corrugated board S reaches the predetermined carrying position (the detection position by the position detector 111) at time t3, and the rear edge of the corrugated board S reaches the predetermined carrying position (the detection position by the position detector 111) at time t5. Therefore, the pulse count detected during the carrying time of the corrugated board S from time t1 to time t3 is the actual arrival pulse Pa. By subtracting the reference arrival pulse Ps from the actual arrival pulse Pa, a carrying delay amount $\Delta L$ ($\Delta a$) is calculated as the carrying delay time. The printing control unit 12A shifts the rotational phase of the printing cylinder 22 (see FIG. 1) of the printing unit 21 by the carrying misalignment amount $\Delta L$ to change the printing position relative to the corrugated board S in the direction of the delay.

As shown in FIG. 3 and FIG. 5, for example processing jobs are set in which a predetermined number of the corrugated boards S of type A, a predetermined number of the corrugated boards S of type B, a predetermined number of the corrugated boards S of type C, and a predetermined number of the corrugated boards S of type A again are to be processed. First, when the predetermined number of the corrugated boards S of type A are processed, with the control device 101, the control unit 123 adjusts the processing position of the corrugated boards S on the basis of a standard carrying misalignment amount a which has been preset. When the box making machinery 10 is processing the predetermined number of the corrugated boards S of type A, the actual arrival pulse calculation unit 121 calculates the actual arrival pulse Pa up to the predetermined carrying position (the detection position by the position detector 111) of the corrugated board S which has been fed out from the feeding unit 11, and the carrying misalignment amount calculation unit 122 calculates a carrying misalignment amount $\Delta a$ of the corrugated boards S by subtracting the reference arrival pulse Ps from the actual arrival pulse Pa. After processing of the corrugated boards S of type A is finished, the carrying misalignment amount calculation unit 122 calculates the average value $\Delta a(1-n)/n$ of the carrying misalignment amounts $\Delta a$ for the corrugated boards S of type A, where n is the number of the corrugated boards S which were detected, and $\Delta a(1-n)$ is the total value of the carrying misalignment amounts Δa for n of the corrugated boards S. The control device 101 stores the average value Δa(1−n)/n of the carrying misalignment amounts Δa for the corrugated boards S of type A in the storage unit 103 as the carrying misalignment amount ΔL. At this time, if the carrying misalignment amount ΔL is already stored in the storage unit 103, the control device 101 updates the average value Δa(1−n)/n of the carrying misalignment amount as the new carrying misalignment amount ΔL.

Next, when processing the predetermined number of the corrugated boards S of type B, the control unit 123 adjusts the processing position of the corrugated boards S on the basis of a correction value b+ΔL of the carrying misalignment amount equal to a standard carrying misalignment amount b which has been preset, added to the carrying misalignment amount ΔL stored in the storage unit 103. When the box making machinery 10 is processing the predetermined number of the corrugated boards S of type B, the actual arrived pulse calculation unit 121 calculates an actual arrived pulse Pb up to the predetermined carrying position (the detection position by the position detector 111) of the corrugated boards S fed from the feeding unit 11, and the carrying misalignment amount calculation unit 122 calculates a carrying misalignment amount Δb of the corrugated boards S by subtracting the reference arrival pulse Ps from the actual arrival pulse Pb. The carrying misalignment amount calculation unit 122 calculates the average value Δb(1−n)/n of the carrying misalignment amounts Δb for the corrugated boards S of type B after processing of the corrugated boards S of type B is finished. The control device 101 updates the carrying misalignment amount ΔL by adding the carrying misalignment amount ΔL which is already stored in the storage unit 103 to the average value Δb(1−n)/n of the carrying misalignment amounts Δb of the corrugated boards S of type B, and stores this in the storage unit 103.

Next, when processing the predetermined number of the corrugated boards S of type C, the control unit 123 adjusts the processing position of the corrugated boards S on the basis of the correction value c+ΔL of the carrying misalignment amount equal to the carrying misalignment amount ΔL stored in the storage unit 103 added to the standard carrying misalignment amount c which has been preset. When the box making machinery 10 is processing the predetermined number of the corrugated boards S of type C, the actual arrival pulse calculation unit 121 calculates an actual arrival pulse Pc up to the predetermined carrying position (the detection position by the position detector 111) of the corrugated boards S fed by the feeding unit 11, and the carrying misalignment amount calculation unit 122 calculates a carrying misalignment amount Δc of the corrugated boards S by subtracting the reference arrival pulse Pa from the actual arrival pulse Pc. The carrying misalignment amount calculation unit 122 calculates the average value Δc(1−n)/n of the carrying misalignment amounts Δc of the corrugated boards S of type C after processing of the corrugated boards S of type C has finished. Δc(1−n) is the total value of the carrying misalignment amounts Δc of n corrugated boards S. The control device 101 updates the carrying misalignment amount ΔL by adding the carrying misalignment amount ΔL already stored in the storage unit 103 to the average value Δc(1−n)/n of the carrying misalignment amounts Δc of the corrugated boards S of type C, and stores this in the storage unit 103.

When processing the predetermined number of the corrugated boards S of type A again, the control unit 123 adjusts the processing position of the corrugated boards S on the basis of the correction value a+ΔL of the carrying misalignment amount which is equal to the carrying misalignment amount ΔL stored in the storage unit 103 added to the standard carrying misalignment amount a which is preset. When the box making machinery 10 is processing the predetermined number of the corrugated boards S of type A, the actual arrival pulse calculation unit 121 calculates the actual arrival pulse Pa up to the predetermined carrying position (the detection position by the position detector 111) of the corrugated boards S which has been fed by the feeding unit 11, and the carrying misalignment amount calculation unit 122 calculates the carrying misalignment amount Δa of the corrugated boards S by subtracting the reference arrival pulse Ps from the actual arrival pulse Pa. The carrying misalignment amount calculation unit 122 calculates the average value Δa(1−n)/n of the carrying misalignment amounts Δa of the corrugated boards S of type A after processing of the corrugated boards S of type A has finished. Δa(1−n) is the total value of the carrying misalignment amounts Δa of n corrugated boards S. The control device 101 updates the carrying misalignment amount ΔL by adding the carrying misalignment amount ΔL already stored in the storage unit 103 to the average value Δa(1−n)/n of the carrying misalignment amounts Δa of the corrugated boards S of type A, and stores this in the storage unit 103.

Incidentally, the carrying misalignment amount ΔL of the corrugated boards S varies depending on the length of the corrugated boards S in the carrying direction D. Specifically, the amount of time the feeding rolls 73, etc., are in contact with the corrugated boards S varies depending on the length in the carrying direction D of the corrugated boards S, and therefore the longer the corrugated boards S are in the carrying direction D, the greater the carrying misalignment amount ΔL of the corrugated boards S becomes. Therefore, as shown in FIG. 6, sheet length (the length of the corrugated boards S in the carrying direction D) and the correction value for the carrying misalignment amount (the carrying misalignment amount ΔL) are in a proportional relationship. Moreover, as shown in FIG. 7, for example, the longer the feeding rolls 73 are used, the greater the amount of wear becomes, and therefore the amount of time the feeding rolls 73 used and the correction value of the carrying misalignment amount (the caring misalignment amount ΔL) are in a proportional relationship. Therefore, as shown in FIG. 6, the slope of the graph of the correction value of the carrying misalignment amount relative to the sheet length is greater, the longer the amount of time the feeding rolls 73 have been used (solid line to dotted line). Note that FIG. 6 expresses the graph representing the correction amount relative to the sheet length (a proportional relationship) as a map, and FIG. 7 shows the graph representing the correction amount relative to the length of time used (a proportional relationship) as a map, and these maps are stored in the storage unit 103.

The map representing the correction values of the carrying misalignment amounts relative to the sheet lengths of the corrugated boards S and the map representing the correction values of the carrying misalignment amounts relative to the lengths of time the feeding rolls 73 are used are stored in the storage unit 103, and the control device 101 corrects the conveying misalignment amount ΔL of the corrugated boards S using these two maps. In this case, the amount of wear on new feeding rolls is zero, and the carrying misalignment amount ΔL is also zero. Therefore, the control device 101 may reset the carrying misalignment amount ΔL stored in the storage unit 103 to 0 on the basis of the replacement signal indicating that the feeding rolls of been replaced with new feeding rolls. Note that this also applies to the feed rolls 17 and the upper carrying roll 77.

The box making machinery according to the present embodiment is a box making machinery which is provided with a feeding unit 11 which has feeding rolls 73 which feed a corrugated board S by coming in contact with at least either a top surface or a bottom surface thereof, a processing device which has processing rolls which carry out processing on the corrugated board S which has been fed by the feeding unit 11, a running register device which adjusts a processing position of the processing device in the carrying direction D of the corrugated board S, and a control device 101 which controls the running register device, in which the control device 101 has a carrying misalignment amount calculation unit 122 which calculates a carrying misalignment amount of the corrugated board S from the feeding unit 11 to a preset predetermined carrying position, and a control unit 123 which adjusts the processing position of the corrugated board S which is to be processed next using the running register device on the basis of the carrying misalignment amount after processing of the corrugated board S is finished.

Accordingly, the carrying misalignment amount of the corrugated board S from the feeding unit 11 to the predetermined carrying position is calculated by the carrying misalignment amount calculation unit 122, and the control unit 123 adjusts the processing position of the corrugated board S which is to be processed next using the running register device on the basis of the carrying misalignment amount after the corrugated board S has been processed. Therefore, when processing the corrugated board S, the carrying misalignment amount which has been found during processing of the corrugated board S previously is used to adjust the processing position using the processing device ahead of time, which eliminates the need for high precision detectors or control equipment and can therefore minimize increases in equipment costs and can minimize drops in productivity by making it possible to carry the corrugated board S at high speeds.

With the box making machinery according to the present invention, an actual arrival pulse calculation unit 121 which calculates an actual arrival pulse from the feeding unit 11 to the predetermined carrying position is provided, and the carrying misalignment amount calculation unit 122 calculates the carrying misalignment amount of the corrugated board S by comparing a preset reference arrival pulse and the actual arrival pulse from the feeding unit 11 to the predetermined carrying position. Because the carrying misalignment amount of the corrugated boards S is calculated by comparing the reference arrival pulse and the actual arrival pulse, the carrying misalignment amount with the corrugated boards S can be calculated with high precision, and even if the carrying speed falls for some reason, the intervals between occurrences of pulses will drop in a similar fashion, allowing accurate calculation of the pulse.

With the box making machinery according to the present invention, an actual arrival time calculation unit 121 which calculates an actual arrival time from the feeding unit 11 to the predetermined carrying position is provided, and the carrying misalignment amount calculation unit 122 calculates the carrying misalignment amount of the corrugated board S by comparing the actual arrival time with a preset reference arrival time from the feeding unit 11 to the predetermined carrying position. Because the carrying misalignment amount of the corrugated boards S is calculated by comparing the reference arrival time and the actual arrival time, the carrying misalignment amount with the corrugated board S can be calculated with high precision. Furthermore, even if sliding occurs between the feeding rolls 73 and the corrugated board S, the actual arrival time can be measured accurately.

With the box making machinery according to the present invention, when processing a predetermined number of corrugated boards S of the same type, the carrying misalignment amount calculation unit 122 calculates an average value of the carrying misalignment amount for the predetermined number of corrugated boards S, and the control unit 123 adjusts the processing position of the corrugated board S to be processed next using the running register device on the basis of the average value of the carrying misalignment amount. Accordingly, even if there is variation among the calculated carrying misalignment amounts, the processing position of the corrugated board S is adjusted on the basis of the average value, and therefore the processing position of the corrugated board S can be adjusted with high precision.

With the box making machinery according to the present invention, a storage unit 103 which stores the carrying misalignment amounts of the corrugated boards S which have been calculated by the carrying misalignment amount calculation unit 122 is provided, and when a carrying misalignment amount for a new corrugated board S is calculated by the carrying misalignment amount calculation unit 122, the carrying misalignment amounts stored in the storage unit 103 are updated. Accordingly, when the carrying misalignment amount calculation unit 122 calculates the carrying misalignment amount for a corrugated board S, the carrying misalignment amount for the most recent corrugated board S is stored in the storage unit 103, and the processing position of the corrugated board S is adjusted always using the most recent carrying misalignment amount even if the type of corrugated board S being processed is changed, thereby making it possible to adjust the processing position of the corrugated boards S with high precision.

With the box making machinery according to the present embodiment, a map expressing the carrying misalignment amounts relative to the carrying direction D length of the corrugated boards S is stored in the storage unit 103, and the carrying misalignment amount calculation unit 122 calculates the carrying misalignment amount of the corrugated board S using the map which is stored in the storage unit. Accordingly, the carrying misalignment amount can be calculated with high precision.

With the box making machinery according to the present embodiment, a standard carrying misalignment amount unique to the corrugated board S is set, and the control unit 123 adjusts the processing position of the corrugated board S which is to be processed next using the running register device on the basis of a carrying misalignment amount correction value in which the carrying misalignment amount is added to the standard carrying misalignment amount. Accordingly, the processing position of the corrugated board S to be processed next is adjusted on the basis of the carrying misalignment correction value in which the carrying misalignment amount is added to the standard carrying misalignment amount, and therefore the processing position of the corrugated board S is adjusted in consideration with the carrying misalignment amount unique to the corrugated board S, thereby making it possible to adjust the processing position of the corrugated board S with high precision.

With the box making machinery according to the present embodiment, a printing unit 21 and the slotter and creaser unit 31 are set as processing devices, and a position detector 111 which detects the corrugated board S which has reached the predetermined carrying position is disposed between the printing unit 21 and the slotter and creaser unit 31. Accordingly, if the position detector 111 is an optical sensor and a belt conveyor is provided to the printing unit 21, the corrugated board S can be detected with high precision moving in the space between the printing unit 21 and the slotter and creaser unit 31 by the position detector 111.

The box making machinery according to the present embodiment is provided with the printing unit 21, the slotter and creaser unit 31, the diecut unit 41, the folding unit 51, and the counter ejector unit 61, and the printing control unit 21A, the slotter control unit 31A, the diecut control unit 41A are provided as running register devices. Accordingly, the control unit 123 adjusts the position where printing is done on the corrugated board S, the position where grooves are cut in the corrugated board S, and the position where the corrugated board S is punched, thereby making it possible to improve the processing precision of the corrugated board S.

Furthermore, a corrugated board running register method according to the present embodiment has a step of calculating the carrying misalignment amount of the corrugated board S from a paper feeding position to a preset predetermined carrying position, and a step of adjusting the processing position of the corrugated board S which is to be processed next on the basis of the carrying misalignment amount after processing of the corrugated board S is finished.

Accordingly, when processing the corrugated board S, the carrying misalignment amount found when processing the previous corrugated board S is used to adjust the processing position by the processing device ahead of time, eliminating the need for high precision detectors and control equipment, which can minimize increases in equipment costs and also minimize drops in productivity by making it possible to use a high speed for carrying the corrugated board S.

Note that in the above embodiment, the pulse detector 110 was configured so as to count pulses generated as a motor constituting a drive device for the feeding rolls 73 and/or the primary creaser rolls 32 and the bearing rolls 37, etc. serving as processing rolls turns, but this is not a limitation. For example, it is also possible to apply the feed rolls 14, the upper carrying roll 77, the second ruled line rolls 33, or other bearing rolls, etc., and the pulse detector 110 may count pulses generated as the motor constituting the drive device for these rolls turns. Furthermore, while not shown in the drawings, it is also possible to install an independent pulse generator and count pulses emitted by the pulse generator.

In the aforementioned embodiment, the control device 101 resets the carrying misalignment amount $\Delta L$ stored in the storage unit 103 on the basis of a replacement signal indicating that the feeding rolls have been replaced with new feeding rolls, but this is not a limitation. It is also possible to reset the carrying misalignment amount $\Delta L$ to zero at a predetermined point when the feeding rolls have become worn. In this case, it is also possible to provide a reset switch and have an operator operate the reset switch when the feeding rolls have become worn by a predetermined amount, to reset the carrying misalignment amount, as an adjustment operation.

EXPLANATION OF THE REFERENCE NUMERALS

11 Feeding unit
12 Feeding table
13 Sheet feeding mechanism
14 Feed rolls (sheet feeding rolls)
21 Printing unit (processing device)
21A Printing control unit (running register device)
31 Slotter and creaser unit (processing device)
31A Slotter control unit (running register device)
32 Primary creaser rolls (processing rolls)
34 Slitter head
35 First slotter heads (upper slotter heads)
36 Second slotter heads (upper slotter heads)
37 Bearing rolls (processing rolls)
39, 40 Lower heads (lower slotter heads)
41 Diecut unit (processing device)
41A Diecut control unit (running register device)
51 Folding unit
61 Counter ejector unit
71 Front guide
72 Backstop
73 Feeding rolls (sheet feeding rolls)
74 Glate plate
75 Suction device
77 Upper carrying roll 77 (sheet feeding roll)
101 Control device
102 Operating unit
103 Storage unit
110 Pulse detector
111 Position detector
121 Actual arrival pulse calculation unit (actual arrival time calculation unit)
122 Carrying misalignment amount calculation unit
123 Control unit
S Corrugated boards

The invention claimed is:

1. A box making machinery comprising:

a paper feeding device including sheet feeding rolls which feed by coming in contact with at least either a top surface or a bottom surface of a corrugated board, a processing device including processing rolls which carry out processing on the corrugated board which has been fed by the paper feeding device, a running register device which adjusts a processing position of the processing device in the carrying direction of the corrugated board, and a control device which controls the running register device, wherein the control device includes a carrying misalignment amount calculation unit which calculates a carrying misalignment amount of the corrugated board from the paper feeding device to a preset predetermined carrying position, and a control unit which adjusts the processing position of the corrugated board which is to be processed next using the running register device on the basis of the carrying misalignment amount after processing of the corrugated board is finished.

2. The box making machinery as claimed in claim 1, wherein an actual arrival pulse calculation unit which calculates an actual arrival pulse produced accompanying rotation of the paper feed roll from the paper feeding device to the predetermined carrying position is provided, and the carrying misalignment amount calculation unit calculates the carrying misalignment amount of the corrugated board by comparing a preset reference arrival pulse and the actual arrival pulse from the paper feeding device to the predetermined carrying position.

3. The box making machinery as claimed in claim 1, wherein an actual arrival pulse calculation unit which calculates an actual arrival pulse produced accompanying rotation of the processing roll from the paper feeding device to the predetermined carrying position is provided, and the carrying misalignment amount calculation unit calculates the carrying misalignment amount of the corrugated board by comparing a preset reference arrival pulse and the actual arrival pulse from the paper feeding device to the predetermined carrying position.

4. The box making machinery as claimed in claim 1, wherein an actual arrival time calculation unit which calculates an actual arrival time from the paper feeding device to the predetermined carrying position is provided, and the carrying misalignment amount calculation unit calculates the carrying misalignment amount of the corrugated board by comparing the actual arrival time with a preset reference arrival time from the paper feeding device to the predetermined carrying position.

5. The box making machinery as claimed in claim 1, wherein when processing a predetermined number of corrugated boards of the same type, the carrying misalignment amount calculation unit calculates an average value of the carrying misalignment amount for the predetermined number of corrugated boards, and the control unit adjusts the processing position of the corrugated board to be processed next using the running register device on the basis of the average value of the carrying misalignment amount.

6. The box making machinery as claimed in claim 1, wherein a storage unit which stores carrying misalignment amounts of the corrugated boards which have been calculated by the carrying misalignment amount calculation unit is provided, and when a carrying misalignment amount for a new corrugated board is calculated by the carrying misalignment amount calculation unit, the carrying misalignment amounts stored in the storage unit are updated.

7. The box making machinery as claimed in claim 6, wherein a map expressing the carrying misalignment amounts relative to the carrying direction length of the corrugated boards is stored in the storage unit, and the carrying misalignment amount calculation unit calculates the carrying misalignment amount of the corrugated board using the map which is stored in the storage unit.

8. The box making machinery as claimed in claim 1, wherein a standard carrying misalignment amount unique to the corrugated board is set, and the control unit adjusts the processing position of the corrugated board which is to be processed next using the running register device on the basis of a carrying misalignment amount correction value in which the carrying misalignment amount is added to the standard carrying misalignment amount.

9. The box making machinery as claimed in claim 1, wherein a printing unit which carries out printing on the corrugated board and a slotter and creaser unit which applies ruled lines to a surface of the corrugated board and cuts grooves therein are provided as processing devices, and a position detector which detects a corrugated board which is reached the predetermined carrying position is disposed between the printing unit and the slotter and creaser unit.

10. The box making machinery as claimed in claim 1, wherein a printing unit which carries out printing on the corrugated board, a paper discharge unit which applies ruled lines to the surface of the corrugated board and cuts grooves therein, a diecut unit which performs punching in the corrugated board, a folding unit which forms a cardboard box into a flat shape by folding the corrugated boards and joining edges thereof, and a counter ejector unit which counts the cardboard boxes and discharges a predetermined number thereof after being stacked are provided, and the running register device adjusts the processing positions of the printing unit, the slotter and creaser unit, and the diecut unit.

* * * * *